US011699427B2

(12) United States Patent
Vandijck et al.

(10) Patent No.: US 11,699,427 B2
(45) Date of Patent: Jul. 11, 2023

(54) WAVEGUIDE ASSEMBLY

(71) Applicant: PSS BELGIUM NV, Dendermonde (BE)

(72) Inventors: Kurt Vandijck, Dendermonde (BE); Thomas Van Den Keybus, Dendermonde (BE)

(73) Assignee: PSS BELGIUM NV, Dendermonde (BE)

( * ) Notice: Subject to any disclaimer, the term of this patent is extended or adjusted under 35 U.S.C. 154(b) by 276 days.

(21) Appl. No.: 17/256,862

(22) PCT Filed: Jun. 24, 2019

(86) PCT No.: PCT/EP2019/066706
§ 371 (c)(1),
(2) Date: Dec. 29, 2020

(87) PCT Pub. No.: WO2020/007636
PCT Pub. Date: Jan. 9, 2020

(65) Prior Publication Data

US 2021/0256955 A1 Aug. 19, 2021

(30) Foreign Application Priority Data

Jul. 4, 2018 (GB) ..... 1810946

(51) Int. Cl.
*G10K 11/30* (2006.01)
*G10K 11/28* (2006.01)
*H04R 1/34* (2006.01)

(52) U.S. Cl.
CPC ..... *G10K 11/30* (2013.01); *G10K 11/28* (2013.01); *H04R 1/345* (2013.01); *H04R 2499/13* (2013.01)

(58) Field of Classification Search
CPC combination set(s) only.
See application file for complete search history.

(56) References Cited

U.S. PATENT DOCUMENTS 2,511,917 A 6/1950 Hornor
4,625,829 A 12/1986 Sirois
(Continued)

FOREIGN PATENT DOCUMENTS

CN 101223815 A 7/2008
CN 1647579 A 11/2014
(Continued)

OTHER PUBLICATIONS

UKIPO, Search Report for corresponding GB Patent Application No. 1810946.2, dated Dec. 12, 2018, 1 page.
(Continued)

*Primary Examiner* — Oyesola C Ojo
(74) *Attorney, Agent, or Firm* — NK Patent Law

(57) ABSTRACT

A waveguide assembly for guiding sound includes a chassis that provides a cavity configured to receive sound propagating in a forwards direction along a primary axis of the waveguide assembly; a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis; a moveable waveguide that is moveable with respect to the chassis between: a standby position in which the moveable waveguide is configured to obstruct the at least one opening and form a forward-facing surface of the waveguide assembly; an operational position in which the moveable waveguide is configured to allow sound to exit the cavity through the at least one opening.

24 Claims, 12 Drawing Sheets

(56) References Cited

U.S. PATENT DOCUMENTS

| | | | | |
|---|---|---|---|---|
| 5,521,983 | A * | 5/1996 | Thompson, III | H03G 5/00 381/94.1 |
| 6,067,224 | A | 5/2000 | Nobuchi | |
| 10,237,636 | B1 * | 3/2019 | Ivey | H04R 1/02 |
| 2005/0002199 | A1 | 1/2005 | Stuffle et al. | |
| 2006/0285712 | A1 * | 12/2006 | Butler | H04R 1/24 381/340 |
| 2007/0003100 | A1 | 1/2007 | Liu | |
| 2007/0064958 | A1 * | 3/2007 | Nakamura | H04R 1/345 381/71.7 |
| 2013/0016864 | A1 * | 1/2013 | Ivey | H04R 1/028 381/340 |
| 2015/0078580 | A1 | 3/2015 | Schwerdtfeger et al. | |
| 2017/0332166 | A1 * | 11/2017 | Kikuchi | H04R 1/025 |
| 2018/0359559 | A1 * | 12/2018 | Bisset | H04R 1/2826 |
| 2018/0367888 | A1 * | 12/2018 | Baird | H04R 9/06 |

FOREIGN PATENT DOCUMENTS

| | | | |
|---|---|---|---|
| DE | 202009015115 | U1 | 1/2010 |
| EP | 1909530 | A1 | 4/2008 |
| JP | 2008124676 | A | 5/2008 |
| WO | 03065761 | A1 | 8/2003 |
| WO | 03075606 | A1 | 9/2003 |
| WO | 2007010800 | A1 | 1/2007 |
| WO | 2017103589 | A1 | 6/2017 |
| WO | 2017211365 | A1 | 12/2017 |

OTHER PUBLICATIONS

ISA/EP, International Search Report and Written Opinion for corresponding PCT Patent Application No. PCT/EP2019/066706, dated Sep. 3, 2019, 13 pages.

* cited by examiner

WAVEGUIDE ASSEMBLY

CROSS REFERENCE TO RELATED APPLICATIONS

This application is a U.S. National Stage Application of International Patent Application No. PCT/EP2019/066706 entitled "WAVEGUIDE ASSEMBLY" filed on Jun. 24, 2019, which claims priority from GB1810946.2 entitled "WAVEGUIDE ASSEMBLY" filed Jul. 4, 2018, the contents and elements of which are herein incorporated by reference for all purposes.

FIELD OF THE INVENTION

The present invention relates to a waveguide assembly and also to a loudspeaker assembly including a waveguide assembly.

BACKGROUND

In the automotive industry, it is common to integrate loudspeaker assemblies in various locations in a car, such as in the dashboard, doors and pillars of the car. The pillars of the car may e.g. include side pillars and/or the "A-pillar" located between the front windscreen and the roof. The position and manner in which loudspeaker assemblies are incorporated into a car will in turn affect the way sound produced by those loudspeaker assemblies will be distributed within the car.

Many loudspeaker assemblies from the automotive industries are exposed to the outside environment and, even when not operational, may need to withstand potentially harmful external influences such as direct UV light, dust and direct contact by a driver or car passenger.

In the automotive industry, sound performance is often a key issue for many consumers, e.g. with many consumers choosing to spend additional money to upgrade the sound system in their car. Consequently, the design and integration of loudspeaker assemblies has become more and more important over time, and many car manufacturers are seeking to improve the performance and reliability of loudspeaker assemblies installed in their cars, and to give their sound systems a premium appearance. Recent developments along these lines include:

- loudspeaker assemblies with visible moving parts
- loudspeaker assemblies with illuminated parts
- loudspeaker assemblies with specific loudspeaker orientations (e.g. such that sound is directed directly towards a specific passenger)
- loudspeaker assemblies with specific locations (e.g. nearby a specific passenger's head to create "3D" and/or "personal" sound for that passenger)
- loudspeaker assemblies incorporating waveguides (sometimes referred to as "acoustic lenses") to change/optimise the way in which sound produced by a loudspeaker is directed towards one or more passengers. Such waveguides may be configured to guide sound so that it is released into the car in directions other than a direction in which the sound was originally produced by the loudspeaker (typically corresponding to a primary axis of the loudspeaker).

Existing waveguide assemblies for use with loudspeakers in cars are typically integrated into the dashboard and/or A-pillar of the car, and have a fixed position in relation to the loudspeaker whose sound they are configured to guide.

The space available on and underneath a surface of a car in which a loudspeaker assembly may be installed (such a surface may be referred to herein as an "installation surface") may be limited in dimensions, for example a car dashboard may have limited space in which to accommodate a loudspeaker assembly.

WO2017/211365 discloses a loudspeaker assembly incorporating an adjustable acoustic lens for controlling the directivity of sound emitted from a loudspeaker. The present inventor has observed that the design of this acoustic lens requires the lowering of the entire loudspeaker assembly into a car interior when it is non-operational (see FIGS. 1-3 of this document), which necessarily requires the loudspeaker assembly to occupy a large volume of space within the car interior.

WO03/065761 discloses a modular loudspeaker intended to be used as a studio monitor, wherein the loudspeaker unit includes a high frequency radiating unit 5, 6 (see FIG. 1) the directional characteristic of which can be controlled by rotation of the high frequency radiating unit.

The present invention has been devised in light of the above considerations.

SUMMARY OF THE INVENTION

In a first aspect, the present invention may provide:

A waveguide assembly for guiding sound, the waveguide assembly including:

- a chassis that provides a cavity configured to receive sound propagating in a forwards direction along a primary axis of the waveguide assembly;
- a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis;
- a moveable waveguide that is moveable with respect to the chassis between:
  - a standby position in which the moveable waveguide is configured to obstruct the at least one opening and, together with the fixed waveguide, form a forward-facing surface of the waveguide assembly;
  - an operational position in which the moveable waveguide is configured to allow sound to exit the cavity through the at least one opening;
- wherein the moveable waveguide is configured to be moved from the standby position to the operational position by retracting at least a part of the moveable waveguide in a rearwards direction along the primary axis of the waveguide assembly, wherein the rearwards direction is opposite to the forwards direction.

In this way, the interior of the waveguide assembly can be protected by the forward-facing surface of the waveguide assembly (formed by the fixed waveguide and the moveable waveguide) when the moveable waveguide is in its standby position, yet can allow sound to exit the waveguide assembly in a guided manner when the moveable waveguide is in the operational position.

Moreover, the waveguide assembly can achieve this effect with a smaller "build-in" height compared with other waveguide assemblies known to the present inventor, such as that disclosed by WO2017/211365, since with a waveguide assembly according to the first aspect of the invention, there is no need to retract the entire waveguide assembly into an installation surface in order to move the moveable waveguide to the standby position.

Moreover, if the waveguide assembly is installed in an installation surface (e.g. a surface of a car such as a dashboard), the forward-facing surface of the waveguide assembly (formed by the fixed waveguide and the moveable waveguide when the moveable waveguide is in the standby position) can be made to match that surface, therefore obscuring the interior of the waveguide assembly from view when the moveable waveguide is in the standby position.

In some examples, the waveguide assembly may include an installation surface including a cavity in which the waveguide assembly is installed. The forward-facing surface of the waveguide assembly (formed by the fixed waveguide and the moveable waveguide when the moveable waveguide is in the standby position) may be configured to match the appearance of the installation surface.

For example, the forward-facing surface of the waveguide assembly may be configured to be flush with respect to the installation surface. In this context, "flush" may be taken to mean not extending substantially beyond the installation surface.

For example the forward-facing surface of the waveguide assembly may be configured to provide a continuation of the installation surface, e.g. by substantially matching the contours of the installation surface.

For avoidance of any doubt, movement of the at least a part of the moveable waveguide in the rearwards direction along the primary axis of the waveguide assembly does not have to involve movement that is exactly parallel with the primary axis of the waveguide assembly, though parallel movement would generally make for a more straightforward implementation of the invention.

In some examples (which may be referred for brevity as "segmented moveable waveguide" examples), the moveable waveguide may include a plurality of moveable waveguide elements, each of which is movable with respect to the chassis between a respective standby position and a respective operational position. Each moveable waveguide element may be configured to be moved from its standby position to its operational position by that moveable waveguide element being retracted in the rearwards direction.

When all the moveable waveguide elements are in their respective standby positions, the moveable waveguide may be viewed as being in its standby position, and when all the moveable waveguide elements are in their respective operational positions, the moveable waveguide may be viewed as being in its operational position.

In a segmented moveable waveguide example, each moveable waveguide element may provide a respective waveguide surface configured to direct sound through the at least one opening formed between the fixed waveguide element and the chassis when the moveable waveguide element is in its operational position. The waveguide surfaces of the moveable waveguide elements may together provide a dished surface (e.g. a frustoconical surface) when the moveable waveguide elements are in their operational positions. If the waveguide assembly is configured to guide sound in a full range of radial directions (see below), the waveguide surface of each moveable waveguide element may extend entirely around the primary axis of the waveguide assembly. If the waveguide assembly is configured to guide sound in a limited range of radial directions (see below), the waveguide surface of each moveable waveguide element may extend partially around the primary axis of the waveguide assembly.

In a segmented moveable waveguide example, each moveable waveguide element may be moveable between a respective standby position and a respective operational position along an axis parallel to the primary axis of the waveguide assembly.

In some examples (which may be referred for brevity as "flexible moveable waveguide" examples), the moveable waveguide may include a flexible waveguide element which is configured to flex so as to be movable with respect to the chassis between a standby position and an operational position. The flexible waveguide element may be configured to be moved from the standby position to the operational position by retracting at least a part of the flexible waveguide element in the rearwards direction.

In a flexible moveable waveguide example, an anchor portion of the flexible waveguide element may be attached to the chassis, preferably with a movable portion of the flexible waveguide element being attached to a movement mechanism of the waveguide assembly (see below). The flexible waveguide element is preferably configured to flex to allow movement of the movable portion of the flexible waveguide element. The anchor portion of the flexible waveguide element is preferably further away from the primary axis of the waveguide assembly than the movable portion of the flexible waveguide element.

In a flexible moveable waveguide example, a waveguide surface of the flexible waveguide element may be configured to provide a dished surface (e.g. a frustoconical surface) when the flexible waveguide element is in its operational position. If the waveguide assembly is configured to guide sound in a full range of radial directions (see below), the waveguide surface of the flexible waveguide element may extend entirely around the primary axis of the waveguide assembly. If the waveguide assembly is configured to guide sound in a limited range of radial directions (see below), the waveguide surface of the flexible waveguide element may extend partially around the primary axis of the waveguide assembly.

The moveable waveguide may be movable to one or more additional operational positions in which the moveable waveguide element is configured to allow sound to exit the cavity through the at least one opening. The additional operational positions may be part way between the standby position and the operational position. The directivity of the waveguide assembly may be different in each operational position.

The waveguide assembly may include a movement mechanism configured to move the moveable waveguide between the standby position and the operational position.

In a segmented moveable waveguide example, the movement mechanism may be configured to move all the moveable waveguide elements between their respective standby positions and their respective operational positions, e.g. one by one in sequence, or at the same time.

In a flexible moveable waveguide example, the moving mechanism may be configured to move the movable portion of the flexible waveguide element.

Various movement mechanisms could be envisaged by a skilled person in view of the disclosure herein.

By way of example, the movement mechanism may include a movement element connected to the moveable waveguide, wherein the movement mechanism is configured to move the movement element in the forwards direction and rearwards direction relative to the primary axis of the waveguide assembly.

By way of example, the movement mechanism may include one or more moveable pins configured to engage with one or more corresponding channels formed in a movement element or (for a segmented moveable waveguide example) in each moveable waveguide element. The movement mechanism may include a motor configured to move the one or more pins.

The movement element may extend around the primary axis of the waveguide assembly. It could be a ring-shaped element, for example.

The movement mechanism may include an electromechanical, electrodynamical or electromagnetic mechanism configured to move the movement element in the forwards direction and rearwards direction, for example.

The waveguide assembly may be configured to guide sound received by the cavity through the at least one opening formed between the fixed waveguide element and the chassis in a full range of radial directions relative to the primary axis of the waveguide assembly (i.e. in a range of directions extending radially outwardly with respect to the primary axis and covering azimuth angles in the range 0 to 360°, relative to a reference radial direction), or in a limited range of radial directions relative to the primary axis of the waveguide assembly (i.e. in a range of directions extending radially outwardly with respect to the primary axis and covering azimuth angles in the range 0 to X°, relative to a reference radial direction, where X is less than 360°).

A limited range of radial directions may be useful e.g. if the waveguide assembly is installed in an installation surface where sound is not required in all radial directions relative to the primary axis of the waveguide assembly, e.g. in a car dashboard.

If the waveguide assembly is configured to guide sound in a full range of radial directions (see above), then the fixed waveguide may be shaped to have its rearward-most point positioned on the primary axis of the waveguide assembly, since this may help to facilitate guiding sound in the full range of radial directions.

If the waveguide assembly is configured to guide sound in a limited range of radial directions (see above), then the fixed waveguide may be shaped to have a curved (e.g. parabolic) surface positioned on the primary axis of the waveguide assembly, since this may help to facilitate guiding sound in the limited range of radial directions.

If the waveguide assembly is configured to guide sound in a full range of radial directions (see above), then the fixed waveguide may be held in place by one or more pillars connected to the chassis. The pillars are preferably small so as to minimise the effect on sound distribution. Such pillars may not be required if the waveguide assembly is configured to guide sound in a limited range of radial directions (see above).

The movable waveguide may include any one or more of the following:

- an elastic/viscoelastic material such as fabric, rubber, foam or polymer;
- a solid material such as metal or plastic;
- a hybrid material such, i.e. a combination of elastic/viscoelastic material and solid material.

Other materials are possible.

The waveguide assembly may include one or more light sources configured to provide illumination of the waveguide assembly.

Preferably, the one or more light sources are configured to provide illumination of the waveguide assembly when the moveable waveguide is in the operational position, optionally also when the moveable waveguide is in the standby position.

Thus, the light source may be configured to produce light (e.g. under control of a control unit) when the moveable waveguide is in the operational position, optionally also when the moveable waveguide is in the standby position.

By way of example, the one or more light sources may include any one or more of:

- one or more light sources located on the fixed waveguide;
- one or more light sources located under a diaphragm of a loudspeaker, if the waveguide assembly is included in a loudspeaker assembly (see below);
- one or more light sources located on the chassis.

In a second aspect, the present invention may provide:

A loudspeaker assembly including:

- a loudspeaker; and
- a waveguide assembly according to the first aspect of the invention;
- wherein the loudspeaker is configured to produce sound that is received by the cavity of the waveguide assembly with the sound received by the cavity of the waveguide assembly propagating in the forwards direction along the primary axis of the waveguide assembly.

The loudspeaker preferably includes:

- a diaphragm; and
- a drive unit configured to move the diaphragm based on an input signal so that the diaphragm produces sound based on the input signal.

Such loudspeakers are of course very well known.

The loudspeaker may be mounted in the chassis of the waveguide assembly with the diaphragm of the loudspeaker being configured to move along a loudspeaker axis which is parallel to (and preferably aligned with) the primary axis of the waveguide assembly, such that sound produced by the diaphragm is directly received by the cavity of the waveguide assembly with the sound received by the cavity of the waveguide assembly with the sound received by the cavity propagating in the forwards direction along the primary axis of the waveguide assembly.

However, it is also possible for the loudspeaker to be mounted in a loudspeaker chassis that is separate from the chassis of the waveguide assembly, e.g. with sound produced by the loudspeaker being guided by a further waveguide to the waveguide assembly, with the further waveguide being configured to guide sound produced by the loudspeaker to be received by the cavity of the waveguide assembly with the sound received by the cavity of the waveguide assembly propagating in the forwards direction along the primary axis of the waveguide assembly. In this case, the loudspeaker axis need not be parallel to the primary axis of the waveguide assembly.

If the loudspeaker is mounted in the chassis of the waveguide assembly (see above), the diaphragm may have an inner edge, an outer edge which is suspended from the chassis, and a diaphragm body which is between the inner and outer edges and extends around the primary axis of the waveguide assembly.

If the loudspeaker is mounted in the chassis of the waveguide assembly (see above), the drive unit may have a stationary part secured to the chassis and a translatable part secured to the inner edge of the diaphragm.

The loudspeaker may be a tweeter.

The diaphragm may have a dome shape, e.g. as is conventional for a tweeter.

The drive unit may be configured to move the diaphragm at frequencies in the range 2 kHz to 20 kHz, e.g. as is conventional for a tweeter.

A third aspect of the invention may provide a vehicle including a waveguide assembly according to the first aspect of the invention or a loudspeaker assembly according to the second aspect of the invention.

The vehicle may be a car, for example.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which:

FIG. 9(*c*) shows the third example loudspeaker assembly viewed from above, with arrows indicating the direction of sound as directed by a waveguide assembly included in the third example loudspeaker assembly.

DETAILED DESCRIPTION OF THE INVENTION

The present inventor has observed that it would be desirable to provide a waveguide assembly suitable for use in a car (and possibly other environments), wherein the including a moveable waveguide capable of transitioning between a standby position and an operational position such that:

the moveable waveguide protects a loudspeaker when the moveable waveguide is in its standby position movement of the moveable waveguide is smooth and is not unduly affected by variations in external conditions such as temperature, dust, car vibrations, or friction of mechanical parts movement of the moveable waveguide avoids unwanted sound in a variety of driving conditions the waveguide assembly is able to influence acoustics in a positive way when the moveable waveguide is in the operational position, yet takes up a small amount of space (in particular, has a small "build-in" height)—a skilled person will appreciate that there will always be some restriction of the degree of freedom of designing moveable mechanical parts, particularly in a car where there are many design requirements to be considered other than sound quality.

Aspects and embodiments of the present invention will now be discussed with reference to the accompanying figures. Further aspects and embodiments will be apparent to those skilled in the art. All documents mentioned in this text are incorporated herein by reference.

Figure 1A:
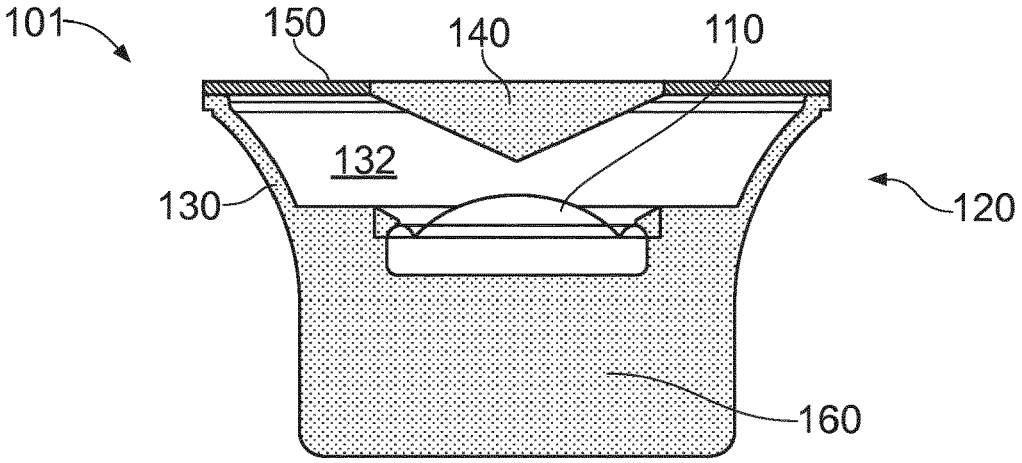
FIGS. 1(*a*)-(*c*) show a first example loudspeaker assembly in cross section.
Figure 1B:
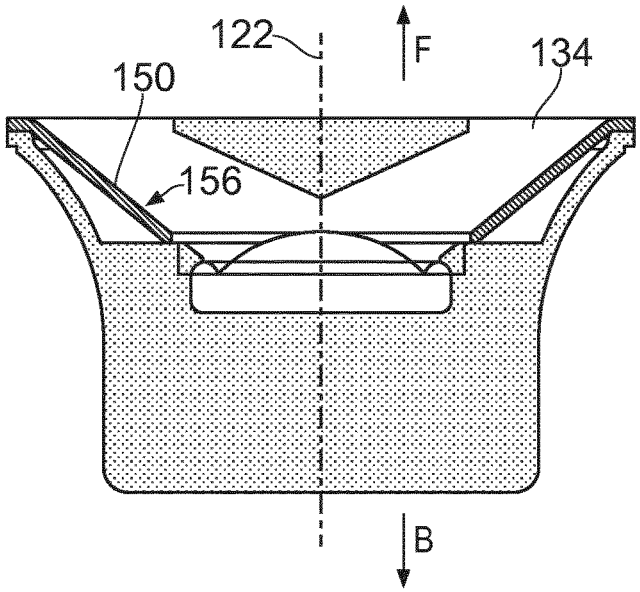
Figure 1C:
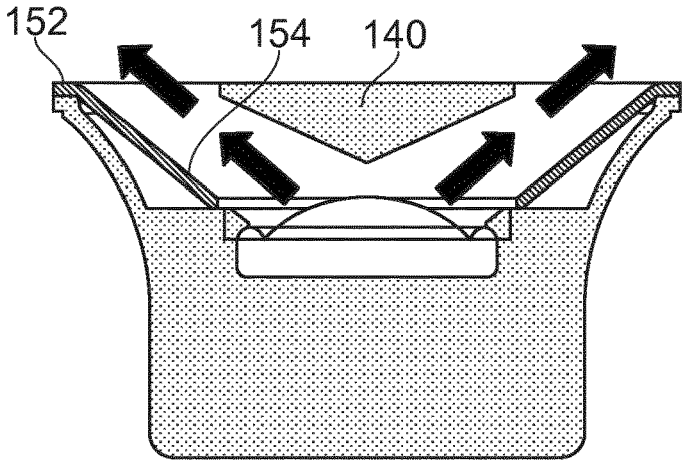

FIGS. 1(*a*)-(*c*) show a first example loudspeaker assembly 101 in cross section.

The loudspeaker assembly includes a loudspeaker 110 and a waveguide assembly 120.

The loudspeaker 110 includes a diaphragm and a drive unit (not shown) configured to move the diaphragm based on an input (electrical) signal so that the diaphragm produces sound based on the input signal.

In this example, the loudspeaker 110 is a tweeter, and the diaphragm has a dome shape, with the dome being concave with respect to the drive unit. In this example, the drive unit is configured to move the diaphragm at frequencies in the range 2 kHz to 20 kHz.

The waveguide assembly 120 is for guiding sound produced by the loudspeaker, and includes a chassis 130, a fixed waveguide 140 and a moveable waveguide 150.

The chassis 130 provides a cavity 132 configured to receive sound propagating in a forwards direction F along a primary axis 122 of the waveguide assembly 120.

The fixed waveguide 140 is fixed with respect to the chassis 130 and positioned on the primary axis 122 of the waveguide assembly 120, wherein the fixed waveguide 140 is spaced apart from the chassis 130 and is configured to guide sound received by the cavity 132 through an opening 134 formed between the fixed waveguide 140 and the chassis 130. In this example, the fixed waveguide 140 has a dedicated shape with its lowest point above the centre of the loudspeaker 110 and on the primary axis 122 of the waveguide assembly 120.

The moveable waveguide 150 is moveable with respect to the chassis 130 between:

a standby position in which the moveable waveguide 150 is configured to obstruct the opening 134 and, together with the fixed waveguide 140, form a forward-facing surface of the waveguide assembly 120 as shown in FIG. 1(*a*);

an operational position in which the moveable waveguide 150 is configured to allow sound to exit the cavity through the opening 134 as shown in FIG. 1(*b*).

In this case the opening 134 is an annular (circular) opening, but in other examples it could have a different shape, e.g. oval.

In this example, the loudspeaker 110 is mounted in the chassis 130 of the waveguide assembly 120 with the diaphragm of the loudspeaker 110 being configured to move along a loudspeaker axis which is parallel to and aligned with (and therefore the same as) the primary axis 122 of the waveguide assembly 120, such that sound produced by the diaphragm is directly received by the cavity 132 of the waveguide assembly 120 with the sound received by the cavity 132 of the waveguide assembly 120 propagating in the forwards direction F along the primary axis 122 of the waveguide assembly 120. The loudspeaker 110 may be viewed as being below the fixed waveguide In this example (which may be referred for brevity as a "flexible moveable waveguide" example), the moveable waveguide 150 is a flexible waveguide element which is configured to flex so as to be movable with respect to the chassis between a standby position shown in FIG. 1(*a*) and an operational position shown in FIG. 1(*b*).

As shown by FIGS. 1(*a*)-(*b*), an anchor portion 152 of the flexible waveguide element is attached to the chassis 130, with a movable portion 154 of the flexible waveguide element being attached to a movement mechanism 160 of the waveguide assembly 120 (described in more detail with reference to FIG. 2, below). The flexible waveguide element is configured to flex to allow movement of the movable portion 154 of the flexible waveguide element. The anchor portion 152 of the flexible waveguide element is located on a periphery of the flexible waveguide element, and is further away from the primary axis 122 of the waveguide assembly 120 than the movable portion 154 of the flexible waveguide element.

The moveable waveguide 150 is configured to be moved from the standby position to the operational position by retracting the movable portion 154 of the moveable waveguide 150 in a rearwards direction R along the primary axis 122 of the waveguide assembly 120, wherein the rearwards direction R is opposite to the forwards direction F.

In this example, the flexible waveguide element is of elastic material, whose anchor portion 152 is connective to the chassis 130.

In the standby position, the moveable waveguide element 150 protects the loudspeaker 110, such that the loudspeaker 110 is not exposed to outside influence and in particular is protected from being touched by a user and protected from being damaged by external conditions (e.g. UV light).

A waveguide surface of the flexible waveguide element is configured to provide a dished surface 156 when the flexible waveguide element is in its operational position, as shown in FIG. 1(*b*). In this example, the dished surface is frustoconical, but in other examples the dished surface may be curved or hyperbolic, for example.

In this example, the waveguide assembly 120 is configured to guide sound in a full range of radial directions, and the fixed waveguide 140 is shaped to have its rearward-most point positioned on the primary axis 122 of the waveguide assembly 120, since this may help to facilitate guiding sound in the full range of radial directions.

The movement mechanism 160 is configured to move the moveable waveguide 150 between the standby position and the operational position.

Figure 2A:
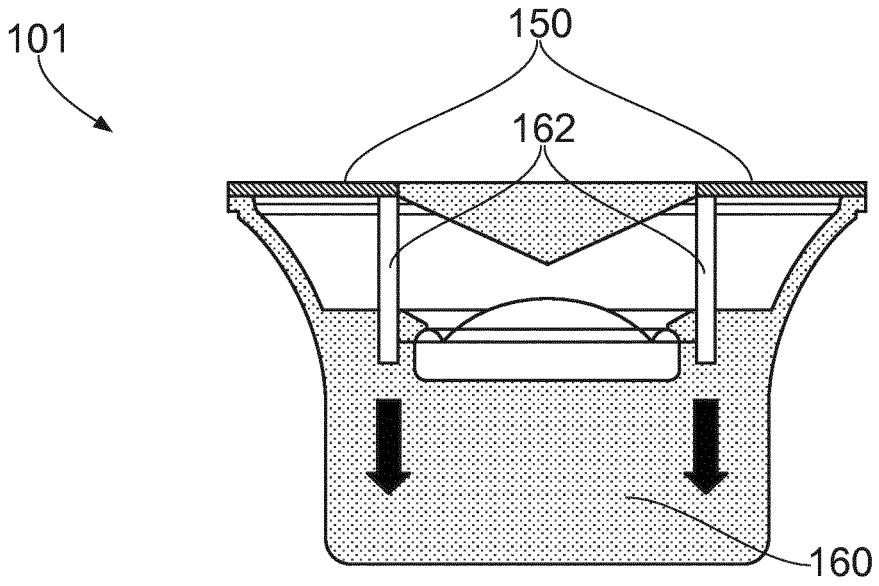
FIGS. 2(*a*)-(*b*) show the first example loudspeaker assembly in cross section, whilst showing the movement mechanism of the first example loudspeaker assembly in more detail.
Figure 2B:
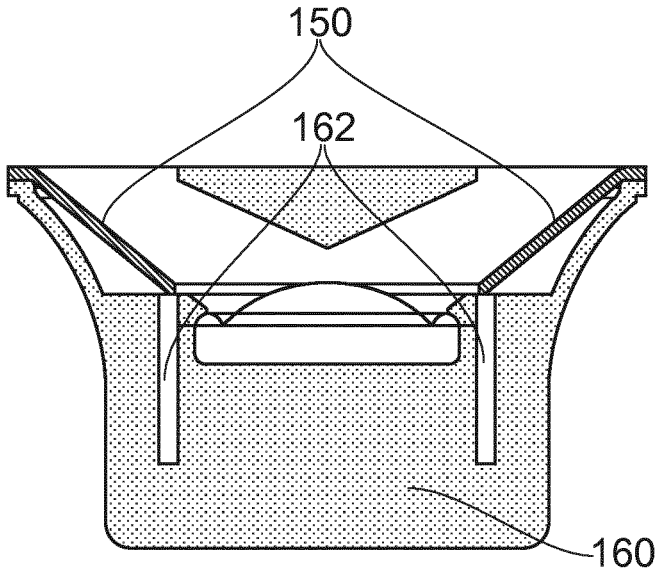

FIGS. 2(*a*)-(*b*) show the first example loudspeaker assembly 101 in cross section, whilst showing the movement mechanism 160 of the first example loudspeaker assembly 101 in more detail.

In this example, the movement mechanism 160 includes a movement element 162 connected to the flexible waveguide element, wherein the movement mechanism is configured to move the movement element 162 in the forwards direction F and rearwards direction R along the primary axis 122 of the waveguide assembly 120, i.e. up and down as shown in FIGS. 2(*a*)-(*b*).

The movement element 162 may extend around the primary axis 122 of the waveguide assembly 120. It could be a ring-shaped element, for example. The movement element 162 may connect to the flexible waveguide element radially inwards of the anchor portion 152, e.g. towards the primary axis 122.

The movement mechanism 160 may use various types of mechanisms, which may be located next to and/or below the loudspeaker 110, for example. Such mechanisms may include, for example:

- a mechanical (e.g. electromechanical driver such as a servo motor) with gears and/or a reduction gearbox
- a mechanical (e.g. electromechanical driver) with a worm wheel and/or a reduction gearbox
- an electrodynamical (e.g. electromagnetic) driver with or without a reduction gearbox (e.g. a voice coil in magnet system)

Control of the movement mechanism 160 may be effected by a control unit (not shown), which may be located in the loudspeaker assembly or in an external unit connected to the loudspeaker assembly.

Figure 12A:
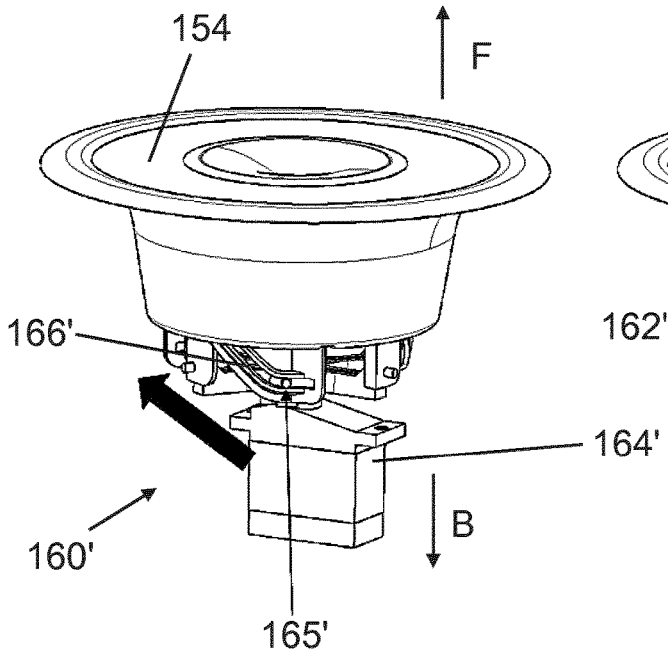
FIGS. 12(*a*)-(*b*) show an alternative movement mechanism for use with the first example loudspeaker assembly.
Figure 12B:
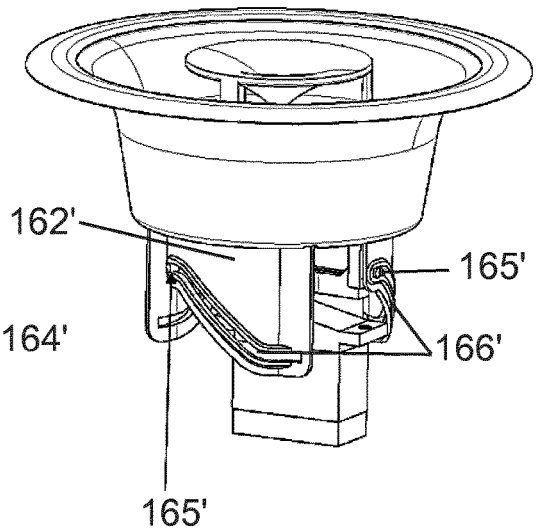

An alternative movement mechanism 160' is shown in FIGS. 12(*a*)-(*b*) and discussed below FIGS. 3(*a*)-(*c*) illustrate different positions in which one or more light sources 170 configured to provide illumination of the waveguide assembly 120 of the first example loudspeaker assembly 101 when the moveable waveguide 150 is in the operational position. Direction of light is illustrated by arrows in FIGS. 3(*a*)-(*c*).

Figure 3A:
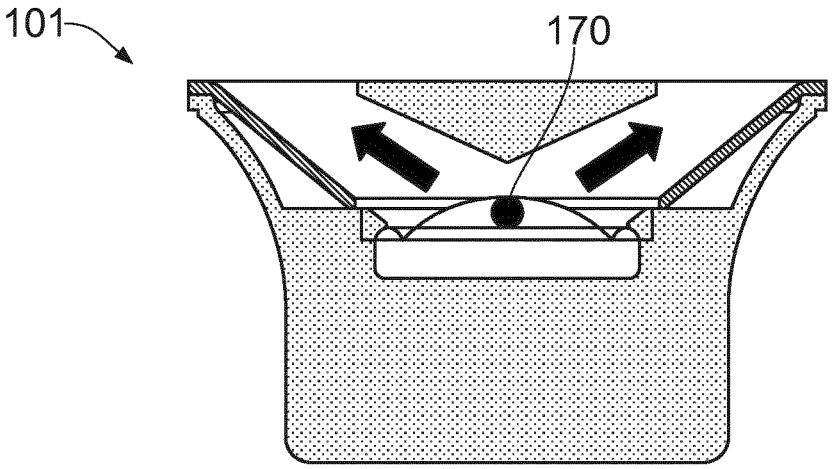
FIGS. 3(*a*)-(*c*) illustrate different positions in which one or more light sources configured to provide illumination of the waveguide assembly of the first example loudspeaker assembly when the moveable waveguide is in the operational position.
Figure 3B:
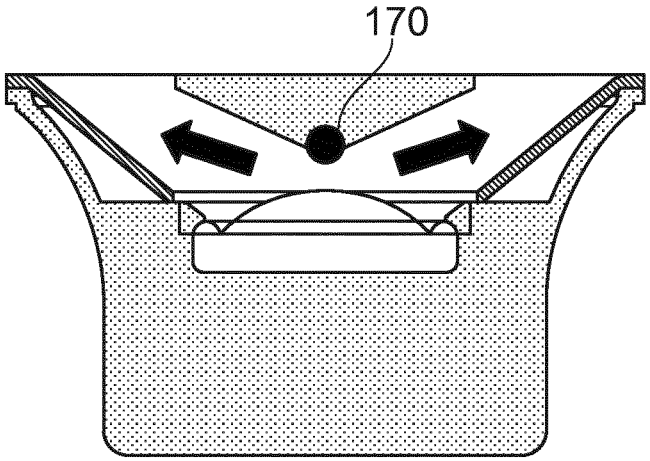
Figure 3C:
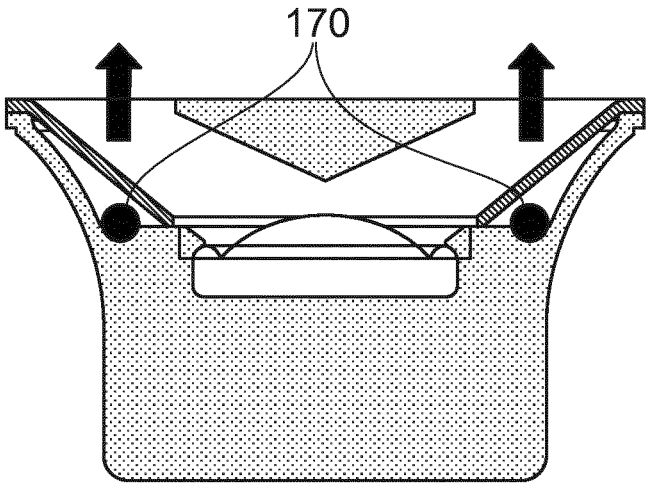

In FIG. 3(*a*), a light source 170 is located under the diaphragm of the loudspeaker. In this case, the diaphragm may include a transparent or translucent material.

In FIG. 3(*b*), a light source 170 is located on the fixed waveguide 140, in this case on a side of the fixed waveguide surface which faces the diaphragm of the loudspeaker 110.

In FIG. 3(*c*), multiple light sources 170 are located on the chassis 130, beside the loudspeaker 110 and underneath the moveable waveguide 150. In this case, the flexible waveguide element may include a transparent or translucent material.

The one or more light sources 170 may be configured to provide illumination of the waveguide assembly when the moveable waveguide 150 is in the operational position as shown in FIGS. 3(*a*)-(*c*), optionally also when the moveable waveguide 150 is in the standby position.

The/each light source may be a one colour, or multiple colour, light source, and may be dimmable e.g. by an electronic control unit.

Figure 4A:
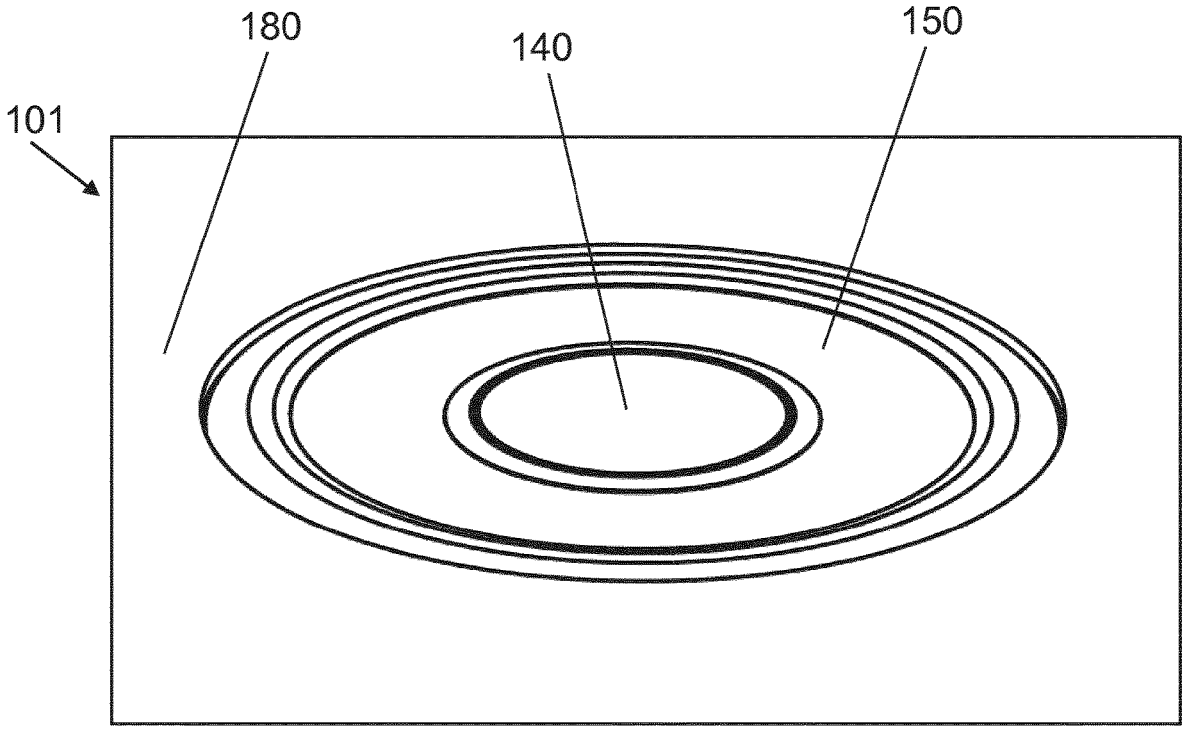
FIGS. 4(*a*)-(*b*) show the first example loudspeaker assembly in perspective view, incorporated into a dashboard of a car.
Figure 4B:
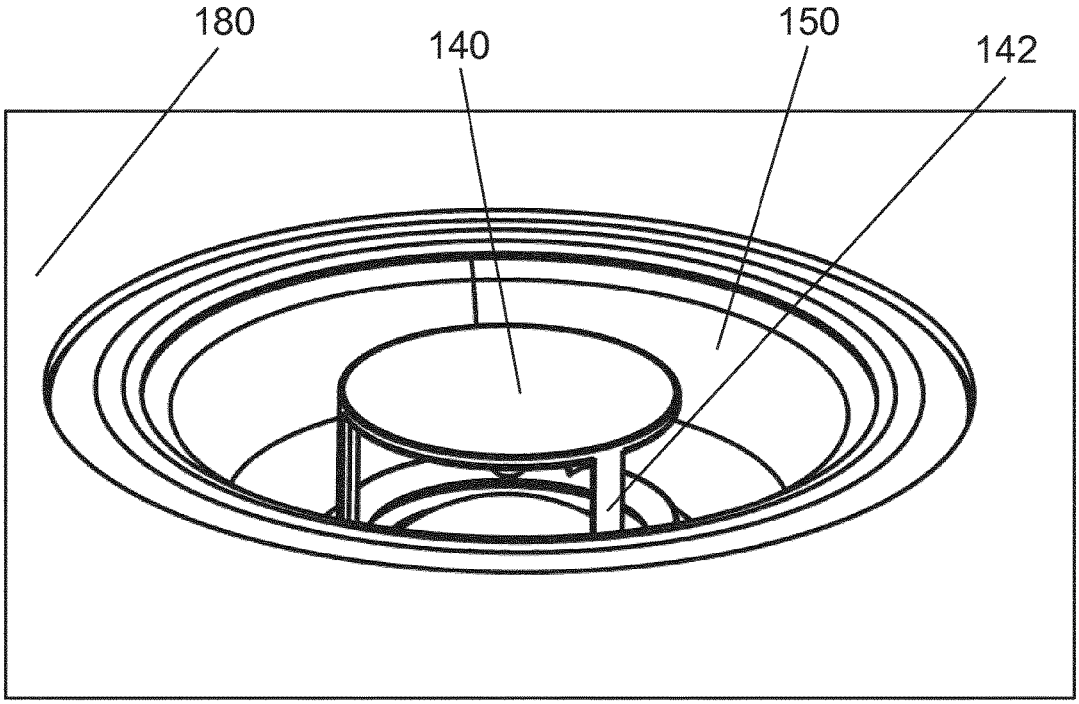

FIGS. 4(*a*)-(*b*) show the first example loudspeaker assembly 101 in perspective view, incorporated into a dashboard 180 of a car.

In FIG. 4(*a*), the moveable waveguide 150 is in the standby position, a forward facing surface of the waveguide assembly formed by the fixed waveguide 140 and the moveable waveguide 150 is flush with respect to (and provides a continuation of) the dashboard 180 (the dashboard 180 can be viewed as an installation surface, in this example).

Since the space available under the dashboard 180 is limited, the loudspeaker assembly 101 is designed to facilitate small dimensions so that the loudspeaker assembly 101 can fit into this limited space.

In FIG. 4(*b*), the moveable waveguide 150 is in the operational position.

FIG. 4(*b*) shows that in this example the fixed waveguide 140 is held in place by three pillars 142 (only two of which are visible) connected to the chassis 130. The pillars 142 are preferably small so as to minimise the effect on sound distribution. Such pillars 142 may not be required if the waveguide assembly 120 is configured to guide sound in a limited range of radial directions (see below).

As can be seen from FIG. 4(*b*), in this example, the waveguide assembly 120 is configured to guide sound in a full range of radial directions when the moveable waveguide 150 is in the operational position, in other words it provides 360° axial directivity of sound produced by the loudspeaker when the flexible waveguide element is in the operational position. This is achieved in part by the dished waveguide surface 156 of the flexible waveguide element extending entirely around the primary axis 122 of the waveguide assembly 120.

The sound distribution of the loudspeaker assembly 101 when the moveable waveguide 150 is in the operational position is illustrated by the arrows in FIG. 1(*c*).

The moveable waveguide 150 may have one or more additional operational positions (not shown) in which the directivity of the loudspeaker assembly 101 is altered, independent of the frequency of sound produced by the loudspeaker.

In this example, the position of the loudspeaker 101 within the chassis 130 is fixed but the position of the loudspeaker 101 within the chassis 130 may be altered or alterable to adapt the directivity of sound produced by the loudspeaker assembly 101.

Figure 5A:
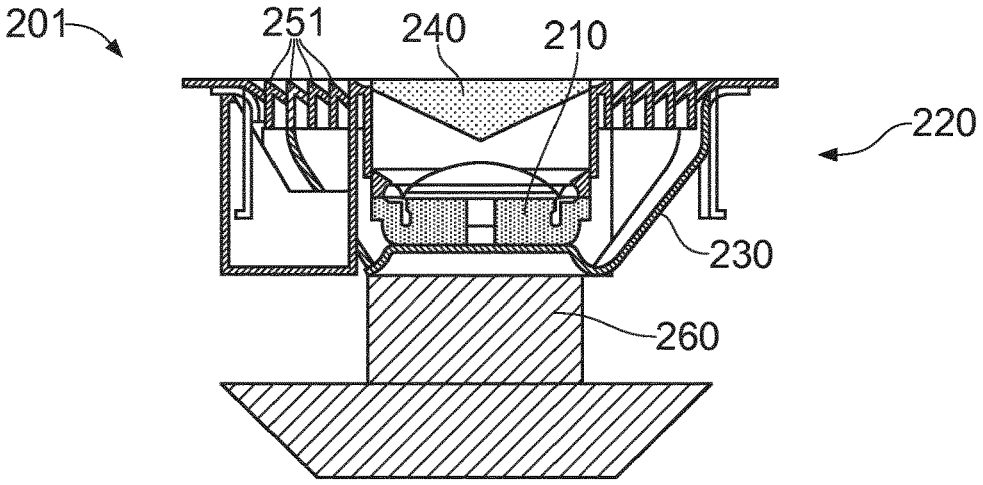
FIGS. 5(*a*)-(*c*) show a second example loudspeaker assembly in cross section.
Figure 5B:
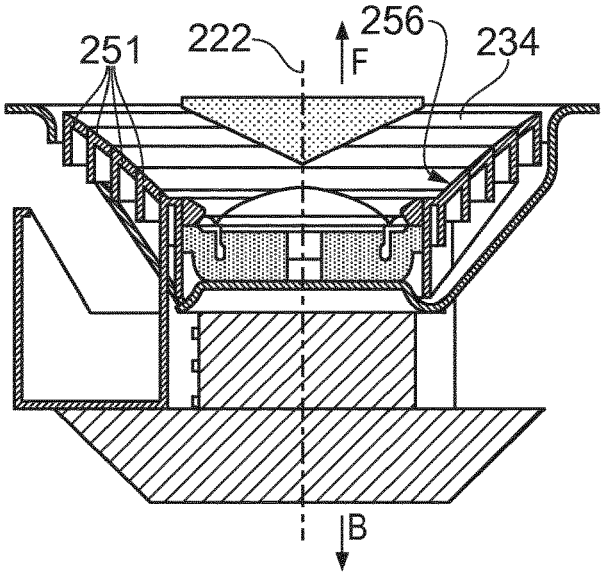
Figure 5C:
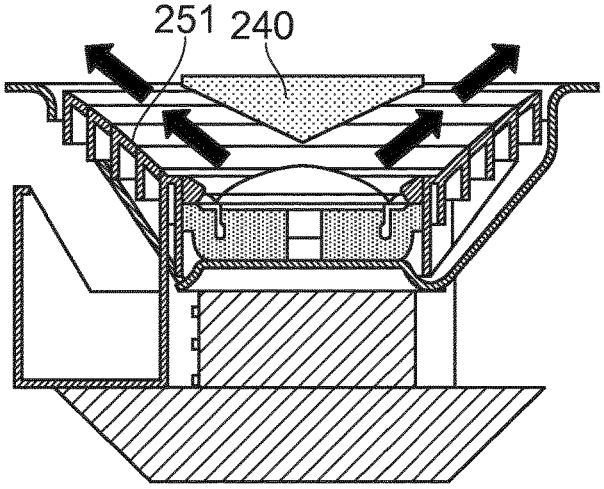

FIGS. 5(*a*)-(*c*) show a second example loudspeaker assembly 201 in cross section.

The second example loudspeaker assembly 201 includes many features corresponding to those in the first example loudspeaker assembly. Similar features have therefore been given corresponding reference numerals and need not be explained further, except where further explanation is provided.

In this example (which may be referred for brevity as a "segmented moveable waveguide" example), the moveable waveguide 250 includes a plurality of moveable waveguide elements 251, each of which is movable with respect to the chassis 230 between a respective standby position and a respective operational position. When all the moveable waveguide elements 251 are in their respective standby positions, the moveable waveguide 250 may be viewed as being in the standby position, and when all the moveable waveguide elements 251 are in their respective operational positions, the moveable waveguide 250 may be viewed as being in the operational position.

In this example, each moveable waveguide element 251 provides a respective waveguide surface configured to direct sound through the at least one opening 234 formed between the fixed waveguide element 240 and the chassis 230 when the moveable waveguide element is in its operational position. The waveguide surfaces of the moveable waveguide elements may together provide a dished surface 256 (a frustoconical surface in the example shown) when the moveable waveguide elements 251 are in their operational positions.

In this example, the waveguide assembly 220 is configured to guide sound in a full range of radial directions, and the waveguide surface of each moveable waveguide element 251 extends entirely around the primary axis 222 of the waveguide assembly 220.

In this example, each moveable waveguide element 251 is moveable between a respective standby position and a respective operational position along the primary axis 222 of the waveguide assembly 220, i.e. up and down as shown in FIGS. 5(*a*)-(*c*).

Figure 6A:
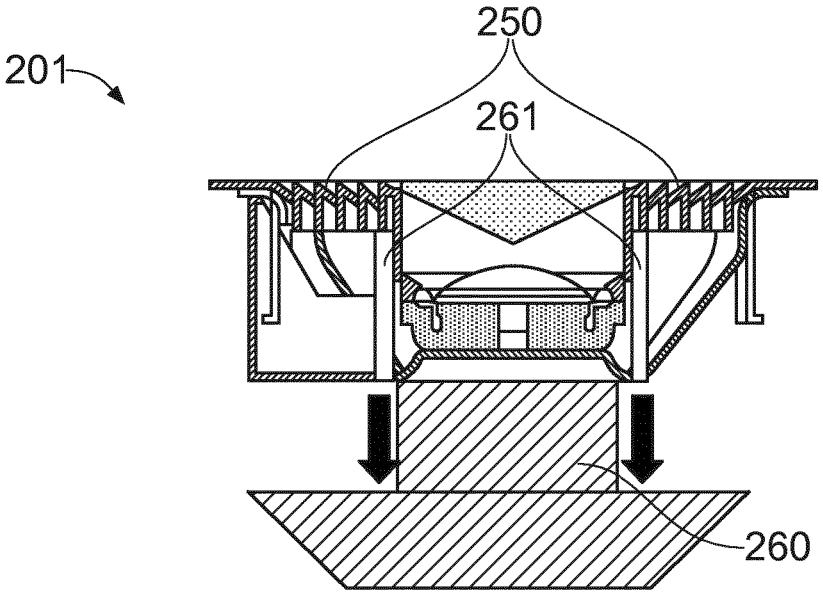
FIGS. 6(*a*)-(*b*) show the second example loudspeaker assembly in cross section, whilst showing the movement mechanism of the second example loudspeaker assembly in more detail.
Figure 6B:
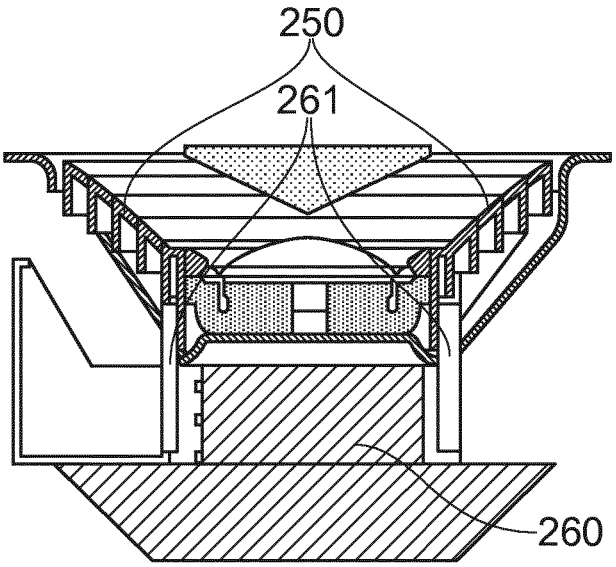

FIGS. 6(*a*)-(*b*) show the second example loudspeaker assembly 201 in cross section, whilst showing the movement mechanism 260 of the second example loudspeaker assembly 201 in more detail.

In this example, the movement mechanism 260 is configured to move all the moveable waveguide elements 251 between their respective standby positions and their respective operational positions.

In this example, the movement mechanism 260 includes a movement element 261 similar to that shown in FIGS. 2(*a*)-(*b*). The movement element 261 is attached to one of the moveable waveguide elements 251 (the centremost element, relative to the primary axis 222 of the waveguide assembly 220). The moveable waveguide elements 251 are connected together so that movement of the moveable waveguide element to which the movement element 261 is attached causes movement of all of the moveable waveguide elements 251. The connection between the moveable waveguide elements may be such that the moveable waveguide elements 251 at the same time as each other between their respective standby positions and their respective operational positions, or one by one in sequence between their respective standby positions and their respective operational positions. Such movement may create a pleasant visual effect for an observer.

Figure 13A:
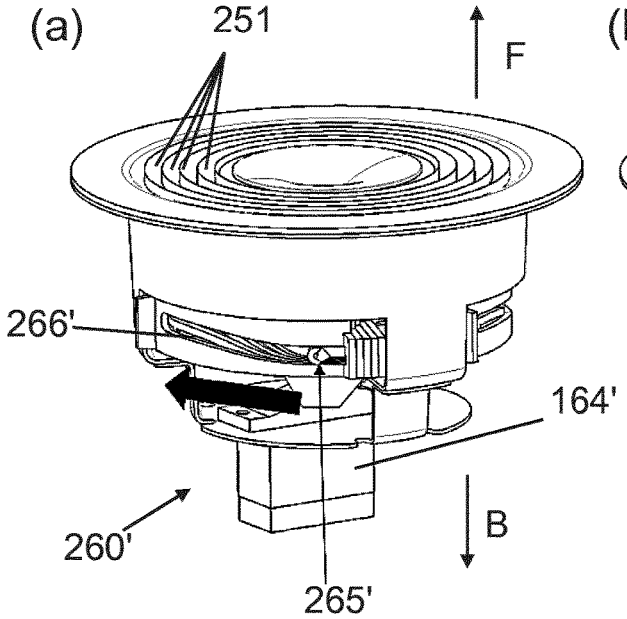
FIGS. 13(*a*)-(*b*) show an alternative movement mechanism for use with the second example loudspeaker assembly.
Figure 13B:
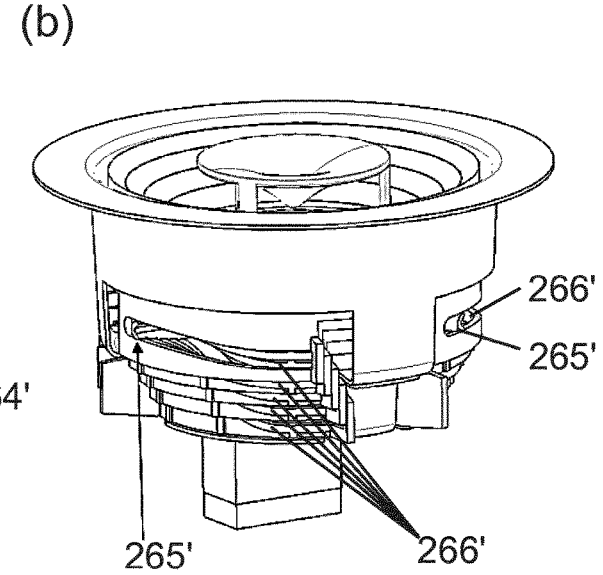

An alternative movement mechanism 260' is shown in FIGS. 13(*a*)-(*b*) and discussed below.

Figure 7A:
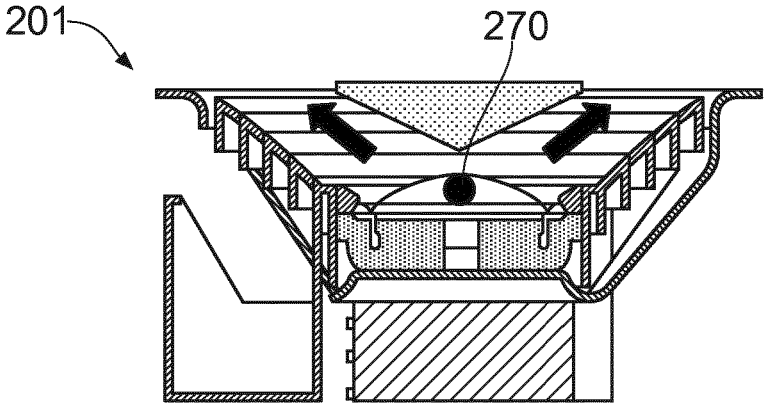
FIGS. 7(*a*)-(*c*) illustrate different positions in which one or more light sources configured to provide illumination of the waveguide assembly of the second loudspeaker assembly when the moveable waveguide is in the operational position.
Figure 7B:
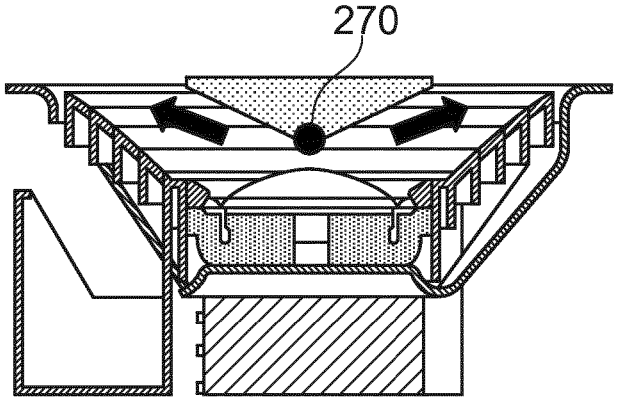
Figure 7C:
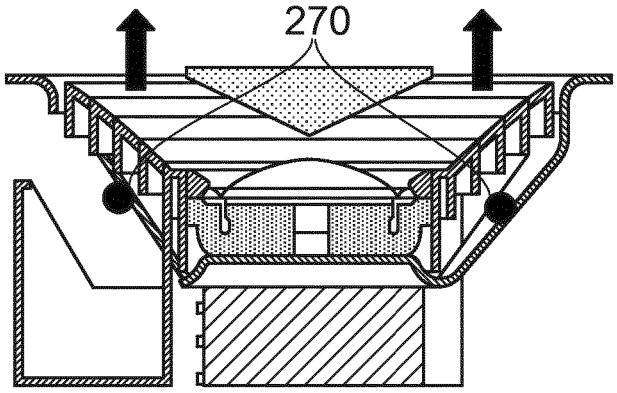

FIGS. 7(*a*)-(*c*) illustrate different positions in which one or more light sources 270 configured to provide illumination of the waveguide assembly 220 of the second loudspeaker assembly 201 when the moveable waveguide 250 is in the operational position. Direction of light is illustrated by arrows in FIGS. 7(*a*)-(*c*).

In FIG. 7(*a*), a light source 270 is located under the diaphragm of the loudspeaker 210. In this case, the diaphragm may include a transparent or translucent material.

In FIG. 7(*b*), a light source 270 is located on the fixed waveguide 240, in this case on a side of the fixed waveguide surface which faces the diaphragm of the loudspeaker 210.

In FIG. 7(*c*), multiple light sources 270 are located on the chassis 230, beside the loudspeaker 210 and underneath the moveable waveguide 260. In this case, one or more of the moveable waveguide elements 251 may include a transparent or translucent material.

The one or more light sources may be configured as described in connection with the first example loudspeaker assembly.

Figure 8A:
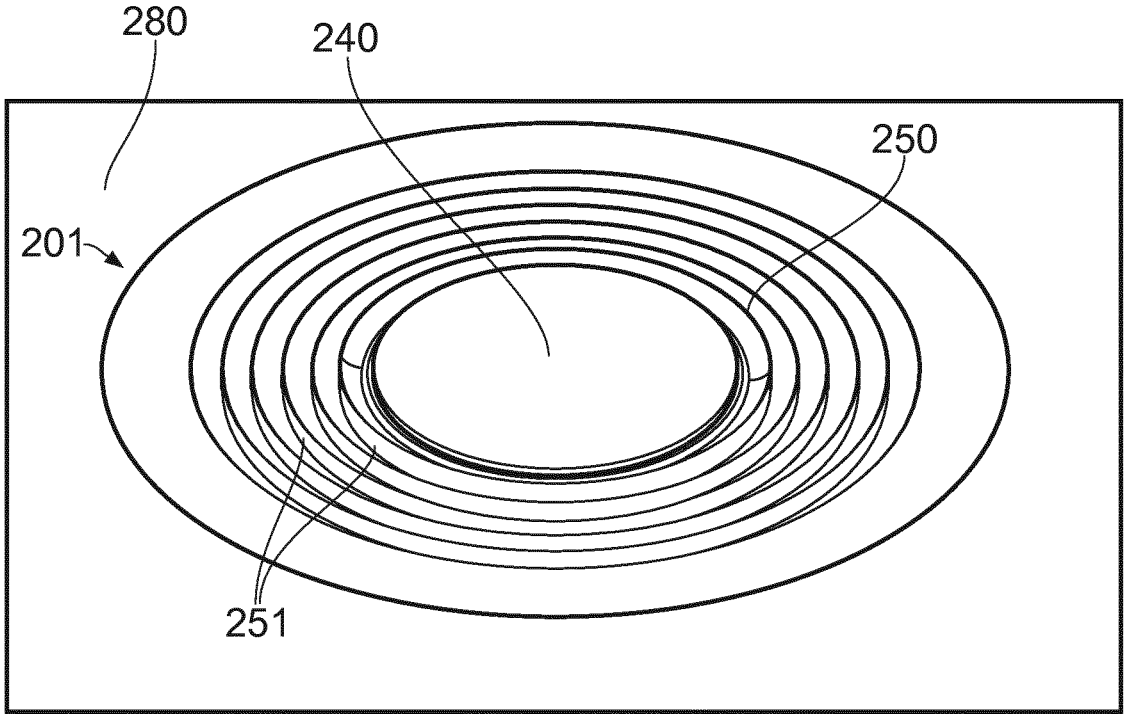
FIGS. 8(*a*)-(*b*) show the second example loudspeaker assembly in perspective view, incorporated into a dashboard of a car.
Figure 8B:
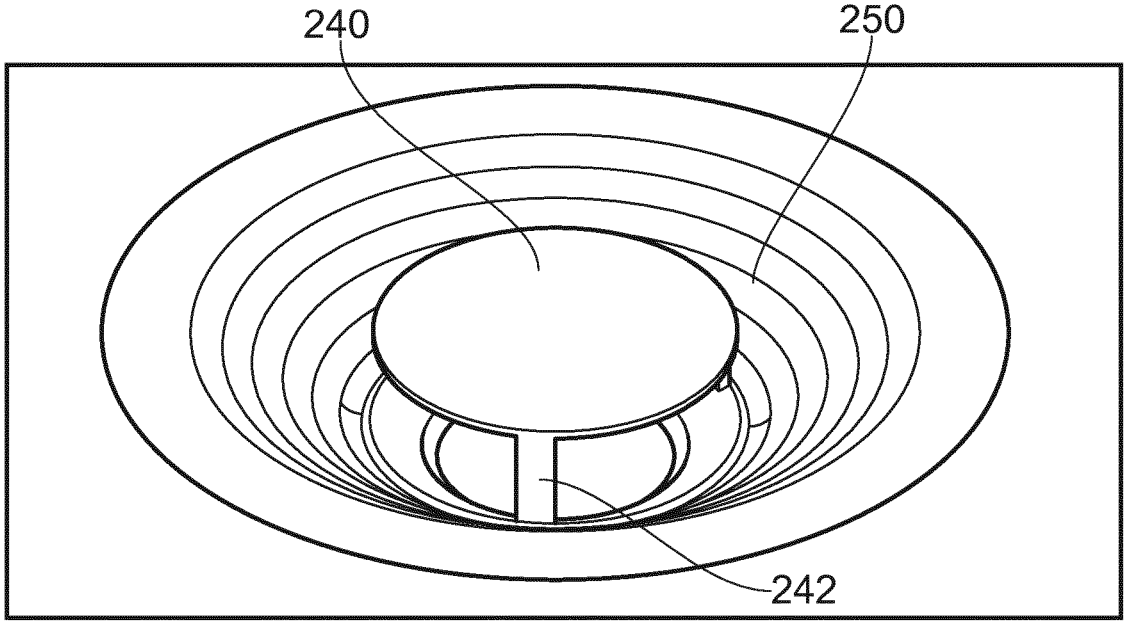

FIGS. 8(*a*)-(*b*) show the second example loudspeaker assembly in perspective view, incorporated into a dashboard of a car.

In FIG. 8(*a*), the moveable waveguide elements 251 are in their standby positions, and a forward facing surface of the waveguide assembly formed by the fixed waveguide 240 and the moveable waveguide elements 251 is flush with respect to (but does not provide a continuation of) the dashboard 280 (the dashboard 280 can be viewed as an installation surface, in this example).

In FIG. 8(*b*), the moveable waveguide elements 251 are in their operational positions.

As can be seen from FIG. 8(*b*), in this example, the waveguide assembly is configured to guide sound in a full range of radial directions when the moveable waveguide 250 is in the operational position, in other words it provides 360° axial directivity of sound produced by the loudspeaker when the moveable waveguide elements 251 are in their operational positions. This is achieved in part by the waveguide surfaces of the moveable waveguide elements 251 extending entirely around the primary axis 222 of the waveguide assembly 220.

The sound distribution of the loudspeaker assembly 201 when the moveable waveguide 250 is in the operational position is illustrated by the arrows in FIG. 5(*c*).

The moveable waveguide elements may have one or more additional operational positions (not shown) in which the directivity of the loudspeaker assembly is altered, independent of the frequency of sound produced by the loudspeaker 210.

Figure 9A:
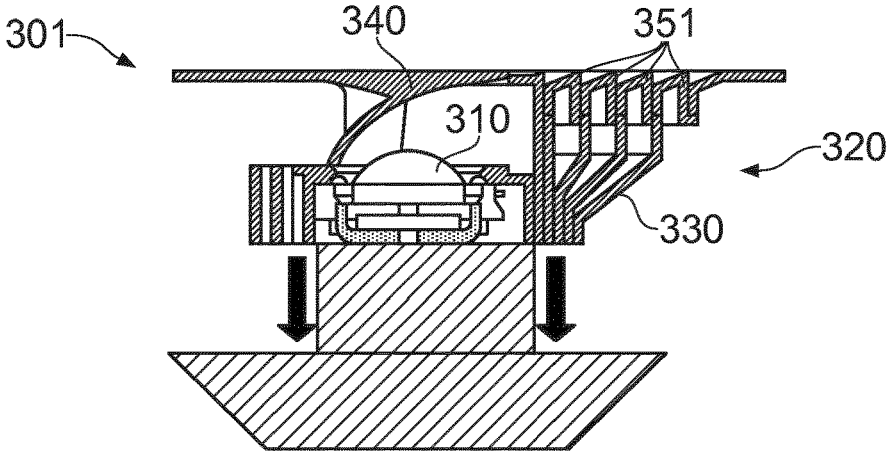
FIGS. 9(*a*)-(*b*) show a third example loudspeaker assembly in cross section.
Figure 9B:
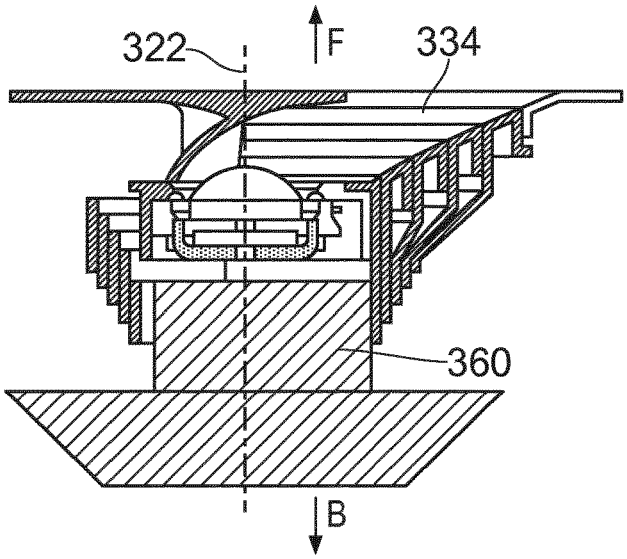
Figure 9C:
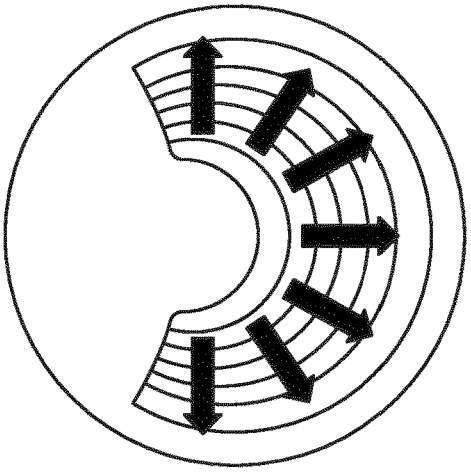

FIGS. 9(*a*)-(*b*) show a third example loudspeaker assembly 301 in cross section.

FIG. 9(*c*) shows the third example loudspeaker assembly 301 viewed from above, with arrows indicating the direction of sound as directed by a waveguide assembly 320 included in the third example loudspeaker assembly 301.

The third example loudspeaker assembly 301 includes many features corresponding to those in the second example loudspeaker assembly 201. Similar features have therefore been given corresponding reference numerals and need not be explained further, except where further explanation is provided.

A key difference between the third example loudspeaker assembly 301 and the second loudspeaker assembly 201 is that in the third loudspeaker assembly 301, the waveguide assembly 320 is configured to guide sound received by the cavity through the opening 334 formed between the fixed waveguide element 340 and the chassis 330 in a limited range of radial directions relative to the primary axis 322 of the waveguide assembly 320 (i.e. in a range of directions extending radially outwardly with respect to the primary axis and covering azimuth angles in the range 0 to X°, relative to a reference radial direction, where X is less than 360°). In this case, in a range of directions covering azimuth angles in the range Since the waveguide assembly 320 is configured to guide sound in a limited range of radial directions, the waveguide surface of each moveable waveguide element 351 extends only partially around the primary axis of the waveguide assembly 320.

Since the waveguide assembly 320 is configured to guide sound in a limited range of radial directions, the fixed waveguide 340 is shaped to have a curved (e.g. parabolic) surface positioned on the primary axis 322 of the waveguide assembly 320, since this may help to facilitate guiding sound in the limited range of radial directions.

The movement mechanism 360 of the third examples loudspeaker assembly 3010 is similar to that described with reference to the second example loudspeaker assembly 201.

Figure 10A:
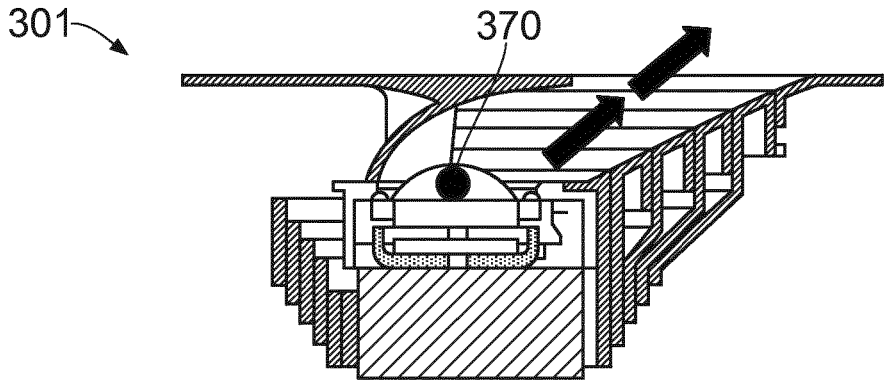
FIGS. 10(*a*)-(*c*) illustrate different positions in which one or more light sources configured to provide illumination of the waveguide assembly of the third loudspeaker assembly when the moveable waveguide is in the operational position.
Figure 10B:
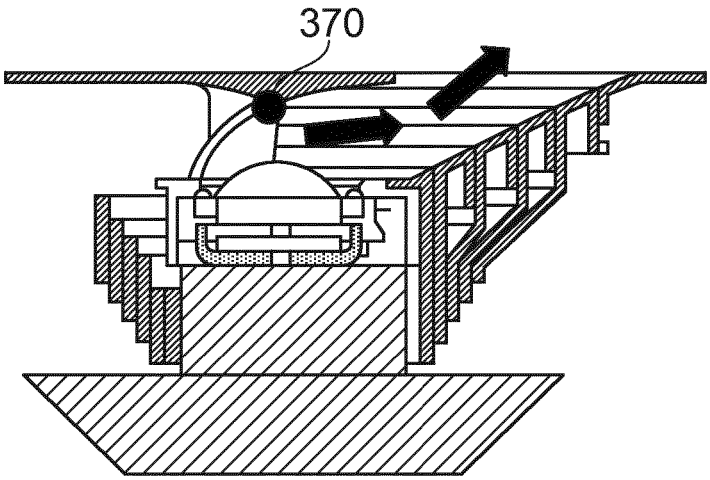
Figure 10C:
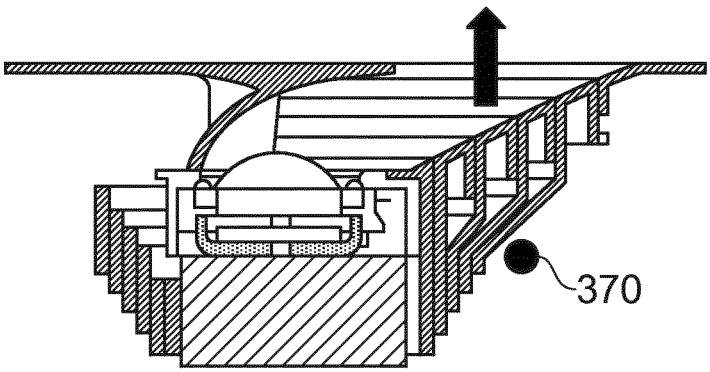

FIGS. 10(*a*)-(*c*) illustrate different positions in which one or more light sources 370 configured to provide illumination of the waveguide assembly 320 of the third loudspeaker assembly 301 when the moveable waveguide 350 is in the operational position. Direction of light is illustrated by arrows in FIGS. 10(*a*)-(*c*).

In FIG. 10(*a*), a light source 370 is located under the diaphragm of the loudspeaker 310. In this case, the diaphragm may include a transparent or translucent material.

In FIG. 10(*b*), a light source 370 is located on the fixed waveguide 340, in this case on a side of the fixed waveguide surface which faces the diaphragm of the loudspeaker 310.

In FIG. 10(*c*), multiple light sources 370 are located on the chassis 330, beside the loudspeaker 310 and underneath the moveable waveguide 350. In this case, one or more of the moveable waveguide elements 351 may include a transparent or translucent material.

The one or more light sources may be configured as described in connection with the first example loudspeaker assembly 101.

Figure 11A:
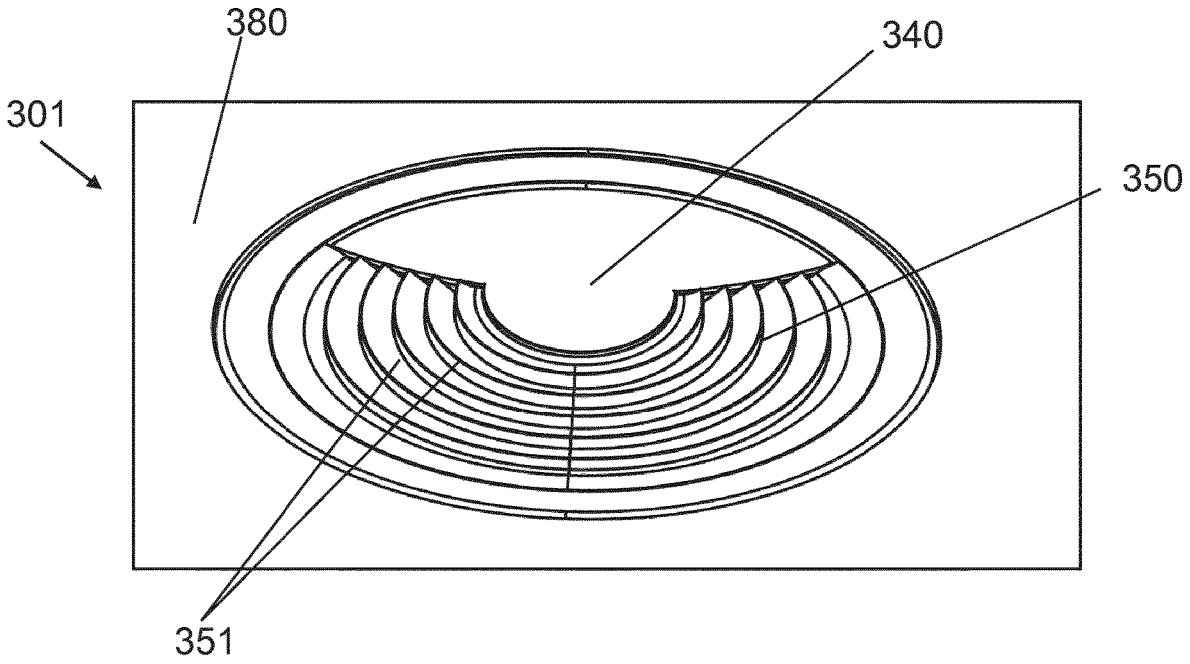
FIGS. 11(*a*)-(*b*) show the third example loudspeaker assembly in perspective view, incorporated into a dashboard of a car.
Figure 11B:
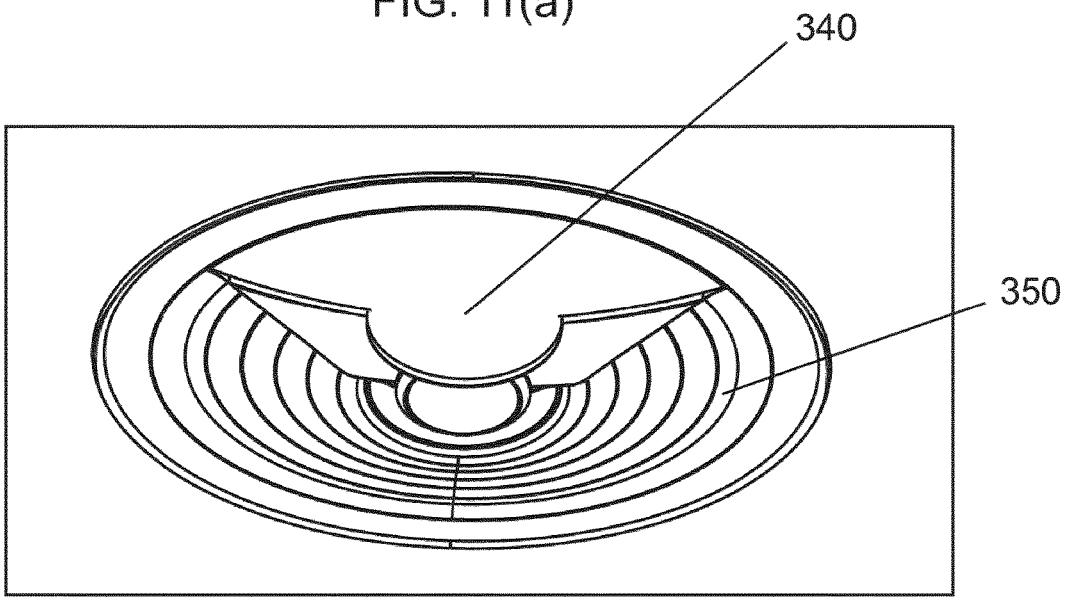

FIGS. 11(*a*)-(*b*) show the third example loudspeaker assembly 301 in perspective view, incorporated into a dashboard 380 of a car.

In FIG. 11(*a*), the moveable waveguide elements 351 are in their standby positions, and a forward facing surface of the waveguide assembly formed by the fixed waveguide 340 and the moveable waveguide elements 351 is flush with respect to (but does not provide a continuation of) the dashboard 380 (the dashboard can be viewed as an installation surface, in this example).

In FIG. 11(*b*), the moveable waveguide elements 351 are in their operational positions.

As can be seen from FIG. 11(*b*), in this example, the waveguide assembly 320 is configured to guide sound in a limited range of radial directions when the moveable waveguide 350 is in the operational position, in other words it provides an asymmetric sound distribution (relative to the primary axis) when the moveable waveguide elements 351 are in their operational positions. This is achieved in part by the waveguide surfaces of the moveable waveguide elements 351 only extending partly around the primary axis 322 of the waveguide assembly 320.

Pillars are not required to support the fixed waveguide 340 in this example.

FIGS. 12(*a*)-(*b*) show an alternative movement mechanism 160' for use with the first example loudspeaker assembly 101.

In this case, the movement mechanism 160' includes a rotary servo motor 164' configured to move a movement element 162' which is attached to the moveable portion 154 of the moveable waveguide 150 of the previously described first example loudspeaker assembly 101.

As shown in FIGS. 12(*a*)-(*b*), rotation of a rotor of the rotary servo motor 164' causes movement of pins 165' (in this case there are three pins, though only two can clearly be seen in the drawings) in corresponding channels 166' formed in the movement element 162'. This movement of the pins 165' causes (through engagement with the channels 166') the movement element 162', and therefore the movable portion 154 of the moveable waveguide 150 to which the movement element 162' is attached, to be retracted in the rearwards direction R, as illustrated by the thick arrow in FIG. 12(*a*).

FIGS. 13(*a*)-(*b*) show an alternative movement mechanism 260' for use with the second example loudspeaker assembly 201.

In this case, the movement mechanism 260' includes a rotary servo motor 264' configured to move each moveable waveguide element 251 of the previously described second example loudspeaker assembly 201.

As shown in FIGS. 13(*a*)-(*b*), rotation of a rotor of the rotary servo motor 264' causes movement of pins 265' (in this case there are three pins, though only two can clearly be seen in the drawings) in corresponding channels 266' formed in each of the moveable waveguide elements 251. This movement of the pins 265' causes (through engagement with the channels 266') each moveable waveguide element 251 to be retracted in the rearwards direction R. By appropriately shaping the channels respectively formed in each moveable waveguide element 251, the movement of the moveable waveguide elements 251 and the extent of such movement in the rearwards direction R can be controlled, e.g. so as to cause the moveable waveguide elements 251 to move one by one in sequence between their respective standby positions and their respective operational positions, or so as to move at the same time as each other between their respective standby positions and their respective operational positions. In the illustrated example, the channels 266' are configured to cause the moveable waveguide elements 251 to move at the same time as each other), as illustrated by the thick arrow in FIG. 13(*a*). Of course, in all the examples discussed above, the geometry of the fixed and moveable waveguides can be optimised and varied according to required sound performance and other design requirements.

A loudspeaker as described above may be used in contexts other than in a car, e.g. in the consumer industry, in the architectural industry (e.g. integrated into a ceiling or wall), in the home entertainment industry, or in the PA industry.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example+/−10%.

The invention claimed is:

1. A waveguide assembly for guiding sound, the waveguide assembly including:

a chassis that provides a cavity configured to receive sound propagating in a forwards direction along a primary axis of the waveguide assembly;

a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis;

a moveable waveguide that is moveable with respect to the chassis between:

a standby position in which the moveable waveguide is configured to obstruct the at least one opening and, together with the fixed waveguide, form a forward-facing surface of the waveguide assembly;

an operational position in which the moveable waveguide is configured to allow sound to exit the cavity through the at least one opening;

wherein the moveable waveguide is configured to be moved from the standby position to the operational position by retracting at least a part of the moveable waveguide in a rearwards direction along the primary axis of the waveguide assembly, wherein the rearwards direction is opposite to the forwards direction;

wherein the moveable waveguide includes a plurality of moveable waveguide elements, each of which is movable with respect to the chassis between a respective standby position and a respective operational position.

2. A waveguide assembly according to claim 1, wherein the waveguide assembly includes an installation surface including a cavity in which the waveguide assembly is installed.

3. A waveguide assembly according to claim 2, wherein the forward-facing surface of the waveguide assembly formed by the fixed waveguide and the moveable waveguide when the moveable waveguide is in the standby position is configured to match the appearance of the installation surface.

4. A waveguide assembly according to claim 1, wherein each moveable waveguide element provides a respective waveguide surface configured to direct sound through the at least one opening formed between the fixed waveguide element and the chassis when the moveable waveguide element is in its operational position.

5. A waveguide assembly according to claim 4, wherein the waveguide surfaces of the moveable waveguide elements together provide a dished surface when the moveable waveguide elements are in their operational positions.

6. A waveguide assembly for guiding sound, the waveguide assembly including:

a chassis that provides a cavity configured to receive sound propagating in a forwards direction along a primary axis of the waveguide assembly;

a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis;

a moveable waveguide that is moveable with respect to the chassis between:

a standby position in which the moveable waveguide is configured to obstruct the at least one opening and, together with the fixed waveguide, form a forward-facing surface of the waveguide assembly;

an operational position in which the moveable waveguide is configured to allow sound to exit the cavity through the at least one opening;

wherein the moveable waveguide is configured to be moved from the standby position to the operational position by retracting at least a part of the moveable waveguide in a rearwards direction along the primary axis of the waveguide assembly, wherein the rearwards direction is opposite to the forwards direction;

wherein the moveable waveguide includes a flexible waveguide element which is configured to flex so as to be movable with respect to the chassis between a standby position and an operational position.

7. A waveguide assembly according to claim 6, wherein an anchor portion of the flexible waveguide element is attached to the chassis, with a movable portion of the flexible waveguide element being attached to a movement mechanism of the waveguide assembly.

8. A waveguide assembly according to claim 6, wherein a waveguide surface of the flexible waveguide element is configured to provide a dished surface when the flexible waveguide element is in its operational position.

9. A waveguide assembly according to claim 1, wherein the waveguide assembly includes a movement mechanism configured to move the moveable waveguide between the standby position and the operational position.

10. A waveguide assembly according to claim 1, wherein the waveguide assembly is configured to guide sound received by the cavity through the at least one opening formed between the fixed waveguide element and the chassis in a full range of radial directions relative to the primary axis of the waveguide assembly.

11. A waveguide assembly according to claim 10, wherein the fixed waveguide is held in place by one or more pillars connected to the chassis.

12. A waveguide assembly according to claim 1, wherein the waveguide assembly is configured to guide sound received by the cavity through the at least one opening formed between the fixed waveguide element and the chassis in a limited range of radial directions relative to the primary axis of the waveguide assembly.

13. A waveguide assembly according to claim 1, wherein the waveguide assembly includes one or more light sources configured to provide illumination of the waveguide assembly, wherein the one or more light sources are configured to provide illumination of the waveguide assembly when the moveable waveguide is in the operational position, optionally also when the moveable waveguide is in the standby position.

14. A waveguide assembly according to claim 6, wherein the waveguide assembly includes a movement mechanism configured to move the moveable waveguide between the standby position and the operational position.

15. A waveguide assembly according to claim 6, wherein the waveguide assembly is configured to guide sound received by the cavity through the at least one opening formed between the fixed waveguide element and the chassis in a full range of radial directions relative to the primary axis of the waveguide assembly.

16. A waveguide assembly according to claim 15, wherein the fixed waveguide is held in place by one or more pillars connected to the chassis.

17. A waveguide assembly according to claim 6, wherein the waveguide assembly is configured to guide sound received by the cavity through the at least one opening formed between the fixed waveguide element and the chassis in a limited range of radial directions relative to the primary axis of the waveguide assembly.

18. A waveguide assembly according to claim 6, wherein the waveguide assembly includes one or more light sources configured to provide illumination of the waveguide assembly, wherein the one or more light sources are configured to provide illumination of the waveguide assembly when the moveable waveguide is in the operational position, optionally also when the moveable waveguide is in the standby position.

19. A loudspeaker assembly including:

a loudspeaker; and a waveguide assembly for guiding sound;

wherein the waveguide assembly includes:

a chassis that provides a cavity configured to receive sound propagating in a forwards direction along a primary axis of the waveguide assembly;

a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis;

a moveable waveguide that is moveable with respect to the chassis between:

a standby position in which the moveable waveguide is configured to obstruct the at least one opening and, together with the fixed waveguide, form a forward-facing surface of the waveguide assembly;

an operational position in which the moveable waveguide is configured to allow sound to exit the cavity through the at least one opening;

wherein the moveable waveguide is configured to be moved from the standby position to the operational position by retracting at least a part of the moveable waveguide in a rearwards direction along the primary axis of the waveguide assembly, wherein the rearwards direction is opposite to the forwards direction;

wherein the moveable waveguide includes a plurality of moveable waveguide elements, each of which is movable with respect to the chassis between a respective standby position and a respective operational position;

wherein the loudspeaker is configured to produce sound that is received by the cavity of the waveguide assembly with the sound received by the cavity of the waveguide assembly propagating in the forwards direction along the primary axis of the waveguide assembly.

20. A loudspeaker assembly according to claim 19, wherein the loudspeaker is mounted in the chassis of the waveguide assembly with the diaphragm of the loudspeaker being configured to move along a loudspeaker axis which is parallel to the primary axis of the waveguide assembly, such that sound produced by the diaphragm is directly received by the cavity of the waveguide assembly with the sound received by the cavity of the waveguide assembly with the sound received by the cavity propagating in the forwards direction along the primary axis of the waveguide assembly.

21. A loudspeaker assembly according to claim 19, wherein the loudspeaker is a tweeter.

22. A loudspeaker assembly including:

a loudspeaker; and a waveguide assembly for guiding sound;

wherein the waveguide assembly includes:

a chassis that provides a cavity configured to receive sound propagating in a forwards direction along a primary axis of the waveguide assembly;

a fixed waveguide that is fixed with respect to the chassis and positioned on the primary axis of the waveguide assembly, wherein the fixed waveguide is spaced apart from the chassis and is configured to guide sound received by the cavity through at least one opening formed between the fixed waveguide element and the chassis;

a moveable waveguide that is moveable with respect to the chassis between:

a standby position in which the moveable waveguide is configured to obstruct the at least one opening and, together with the fixed waveguide, form a forward-facing surface of the waveguide assembly;

an operational position in which the moveable waveguide is configured to allow sound to exit the cavity through the at least one opening;

wherein the moveable waveguide is configured to be moved from the standby position to the operational position by retracting at least a part of the moveable waveguide in a rearwards direction along the primary axis of the waveguide assembly, wherein the rearwards direction is opposite to the forwards direction;

wherein the moveable waveguide includes a flexible waveguide element which is configured to flex so as to be movable with respect to the chassis between a standby position and an operational position;

wherein the loudspeaker is configured to produce sound that is received by the cavity of the waveguide assembly with the sound received by the cavity of the waveguide assembly propagating in the forwards direction along the primary axis of the waveguide assembly.

23. A loudspeaker assembly according to claim 22, wherein the loudspeaker is mounted in the chassis of the waveguide assembly with the diaphragm of the loudspeaker being configured to move along a loudspeaker axis which is parallel to the primary axis of the waveguide assembly, such that sound produced by the diaphragm is directly received by the cavity of the waveguide assembly with the sound received by the cavity of the waveguide assembly with the sound received by the cavity propagating in the forwards direction along the primary axis of the waveguide assembly.

24. A loudspeaker assembly according to claim 22, wherein the loudspeaker is a tweeter.

* * * * *